US008281595B2

(12) United States Patent
Davis, Jr. et al.

(10) Patent No.: US 8,281,595 B2
(45) Date of Patent: Oct. 9, 2012

(54) FUSE FOR FLAME HOLDING ABATEMENT IN PREMIXER OF COMBUSTION CHAMBER OF GAS TURBINE AND ASSOCIATED METHOD

(75) Inventors: Lewis Berkley Davis, Jr., Schenectady, NY (US); Stanley Kevin Widener, Greenville, SC (US); John Wilber, Bristol, CT (US)

(73) Assignee: General Electric Company, Schenectady, NY (US)

( * ) Notice: Subject to any disclaimer, the term of this patent is extended or adjusted under 35 U.S.C. 154(b) by 1167 days.

(21) Appl. No.: 12/128,231

(22) Filed: May 28, 2008

(65) Prior Publication Data

US 2009/0293482 A1 Dec. 3, 2009

(51) Int. Cl.
*F02C 1/00* (2006.01)
*F02G 3/00* (2006.01)

(52) U.S. Cl. ..... 60/747; 60/740; 60/746; 60/742; 60/737; 60/776

(58) Field of Classification Search ..... 60/740, 60/737, 742, 746, 747, 39.11, 776
See application file for complete search history.

(56) References Cited

U.S. PATENT DOCUMENTS

| | | | | |
|---|---|---|---|---|
| 4,258,544 | A * | 3/1981 | Gebhart et al. | 60/800 |
| 5,685,139 | A * | 11/1997 | Mick et al. | 60/776 |
| 6,282,904 | B1 | 9/2001 | Kraft et al. | |
| 6,429,020 | B1 | 8/2002 | Thornton et al. | |
| 6,446,439 | B1 | 9/2002 | Kraft et al. | |
| 6,675,581 | B1 | 1/2004 | Stuttaford et al. | |
| 6,698,207 | B1 | 3/2004 | Wiebe et al. | |
| 6,772,583 | B2 | 8/2004 | Bland | |
| 6,786,046 | B2 * | 9/2004 | Wiebe et al. | 60/737 |
| 6,786,047 | B2 | 9/2004 | Bland et al. | |
| 6,848,260 | B2 | 2/2005 | North et al. | |
| 6,886,346 | B2 | 5/2005 | Sobieski et al. | |
| 6,915,636 | B2 | 7/2005 | Stuttaford et al. | |
| 2007/0125092 | A1 | 6/2007 | Wolfe et al. | |

* cited by examiner

*Primary Examiner* — William H Rodriguez
*Assistant Examiner* — Craig Kim
(74) *Attorney, Agent, or Firm* — Nixon & Vanderhye P.C.

(57) ABSTRACT

A fuel nozzle assembly for a combustor of a gas turbine including: a nozzle body having a front and an inner tube defining a fuel passage extending through the nozzle body, wherein the front proximate to a combustion section of the combustor; an outer casing around the inner tube, wherein an air passage is defined between the outer casing and the inner tube; a gas conduit arranged in the air passage and having an outlet proximate to the front of the nozzle body, wherein fuel starts flowing through the expandable conduit only after a flashback condition occurs in the combustor, and a premix fuel passage and port discharging fuel to a premix section of the combustor, wherein the gas conduit has an inlet open to the premix fuel passage.

20 Claims, 5 Drawing Sheets

FUSE FOR FLAME HOLDING ABATEMENT IN PREMIXER OF COMBUSTION CHAMBER OF GAS TURBINE AND ASSOCIATED METHOD

BACKGROUND OF THE INVENTION

This invention relates to gas turbine combustion systems and, specifically, to a fuel nozzle design which minimizes combustor damage during a combustion flame flashback or flame holding event.

A gas turbine combustor mixes large quantities of fuel and compressed air and burns the resulting mixture. Conventional combustors for industrial gas turbines typically include an annular array of cylindrical combustion "cans" in which air and fuel are mixed and combustion occurs. Compressed air from an axial compressor flows into the combustor. Fuel is injected through fuel nozzle assemblies that extend into each can. The mixture of fuel and air burns in a combustion chamber of each can. The combustion gases discharge from each can into a duct that leads to the turbine.

Combustion cans, designed for low emissions, include premix chambers and combustion chambers. Fuel nozzle assemblies in each combustion can inject fuel and air into the chambers of the can. A portion of the fuel from the nozzle assembly is discharged into the premix chamber of the can, where air is added to and premixed with the fuel. Premixing air and fuel in the premix chamber promotes rapid and efficient combustion in the combustion chamber of each can, and low emissions from the combustion. The mixture of air and fuel flows downstream from the premix chamber to the combustion chamber which supports combustion and under some conditions receives additional fuel discharged by the front of the fuel nozzle assembly. The additional fuel provides a means of stabilizing the flame for low power operation, and may be completely shut off at high power conditions.

A flashback or flame holding condition may occur in combustion cans having premix chambers. The premix chambers are not intended to support combustion. Flashback occurs when flame propagates into the premix chamber from the downstream combustion chamber, typically caused by momentary transient conditions. Flame holding occurs when a flame is initiated in the premixing zone, possibly by an external source such as a spark or hot foreign object ejected by the compressor, and the flame then stabilizes in a recirculation zone or weak boundary layer zone immediately downstream of the portion of the fuel nozzle assembly discharging fuel into the premix chamber. The damage resulting from flashback or flame holding may include burning combustor components not intended to be subjected to the heat of combustion. The damage caused by burning these combustor components may cause the components to malfunction and break up. If broken sections of the combustor flow into the combustion gas stream, they potentially may damage the hot gas path, e.g., turbine in the gas turbine.

Fuses in fuel nozzle assemblies prevent flame holding by diverting fuel away from the fuel nozzles for the premix chamber. The diversion of fuel from the premix chamber causes the abnormal flame to burn out and prevents further combustion in the premix chamber. However, conventional fuse designs, such as disclosed in U.S. Pat. No. 5,685,139, are not suited to all types of fuel nozzle assemblies. Accordingly, there is a need for novel designs of fuses.

BRIEF DESCRIPTION OF THE INVENTION

A fuel nozzle assembly for a combustor of a gas turbine has been developed comprising: a nozzle body having a front and an inner tube defining a fuel passage extending through the nozzle body; an outer tube around the inner tube and defining an air passage between the outer tube and the inner tube; a weakened region of the outer tube which burns through in event of a flashback thereby causing a portion of premix fuel to bypass the injectors and to be discharged from the weakened region; an expandable conduit arranged in the air passage and having an outlet adjacent the weakened region, wherein fuel flows through the expandable conduit when the weakened region of the outer tube burns through and the fuel flow is discharged from the conduit, through the weakened region and towards the front of the nozzle body, and a collar attached to the nozzle body, the collar including a premix fuel passage and ports discharging fuel from the collar, wherein the expandable conduit has an inlet open to the premix fuel passage.

A method has been developed for quenching a flashback condition in a combustor of a gas turbine, the method comprising: injecting fuel and compressed air from a fuel injector assembly to a premix chamber of the combustor, wherein the injected fuel and compressor air does not normally combust in the premix chamber; combusting the fuel and compressed in a combustion chamber downstream of the premix chamber in the combustor; providing air to the combustion chamber from a front of the injector assembly through an air passage extending through a nozzle body of the fuel injector; injecting fuel to the combustion chamber from a fuel passage having an outlet at the front of the injector assembly; opening an outlet of a conduit in response to a flashback condition adjacent the fuel injector assembly, wherein the outlet is proximate the front of the injector assembly and the conduit extends through the air passage; diverting fuel from the premix chamber to the conduit by the opening of the outlet, and quenching flames of the flashback condition by the diversion of fuel.

DETAILED DESCRIPTION OF THE INVENTION

Figure 1:
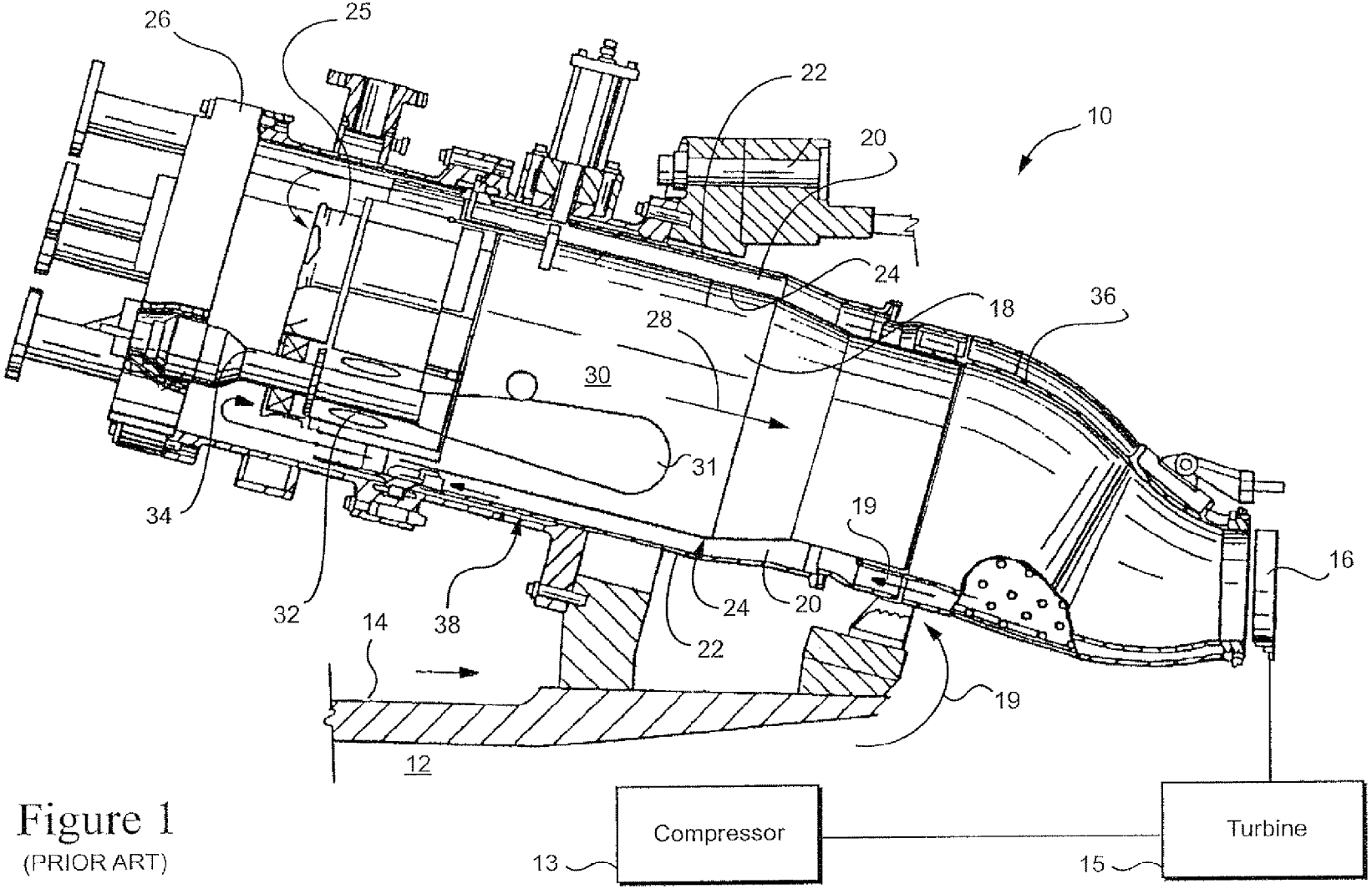
Figure 1 (PRIOR ART)
FIG. 1 is a side view showing in partial cross-section a conventional combustion can of a gas turbine.

FIG. 1 is side view, showing in partial cross section, a conventional combustor 10 of a gas turbine 12 that includes a compressor 13 (represented by compressor casing 14), and a turbine section 15 represented by a single turbine blade 16. The combustor includes an annular array of combustion cans 18 arranged around the compressor casing 14. The compressor 13 is driven by the turbine which is drivingly connected along a common axis to the compressor.

Pressurized air from the compressor enters each combustion can 18 the combustor 10 and flows (see air arrow 19) through an annular duct 20 formed between a cylindrical sleeve 22 and an inner cylindrical liner 24 of the can. Compressed air flows through the duct 20 towards the end cover assembly 26 of the can in a reverse flow direction to the combustion gases formed in the can (see combustion gas arrow 28). Air enters the combustion chamber 30 and premix chambers 32 in each can through various openings in the liner 24 and through the premixer inlets 25 in the fuel nozzle assemblies 34.

A mixture of fuel and air is supplied to the premix chambers 32 and the combustion chamber by fuel nozzle assemblies 34 arranged at the front of the can and attached to the end cover. The fuel and compressed air mix in the premix chamber and flow to the combustion chamber 30. The mixture burns in the combustion chamber and the resulting combustion gases flow (see combustion flow arrow 28) from the cans to a transition duct 36 that directs the combustion gases to the turbine blades 16.

Each combustion can 18 includes a substantially cylindrical combustion casing 38 which is secured at an open aftward end to the compressor casing 14. The forward end of the combustion can is closed by the end cover assembly 26 which may include conventional fuel supply tubes, manifolds and associated valves for feeding gas, liquid fuel and air (and water if desired) to the combustor can. The end cover assembly 26 supports multiple fuel nozzle assemblies 34 for each can. For example, fuel nozzle assemblies may be arranged in a circular array around a center nozzle assembly. These nozzle assemblies may be treated has having the same structure, at least for purposes of describing the fuse system.

Figure 2:
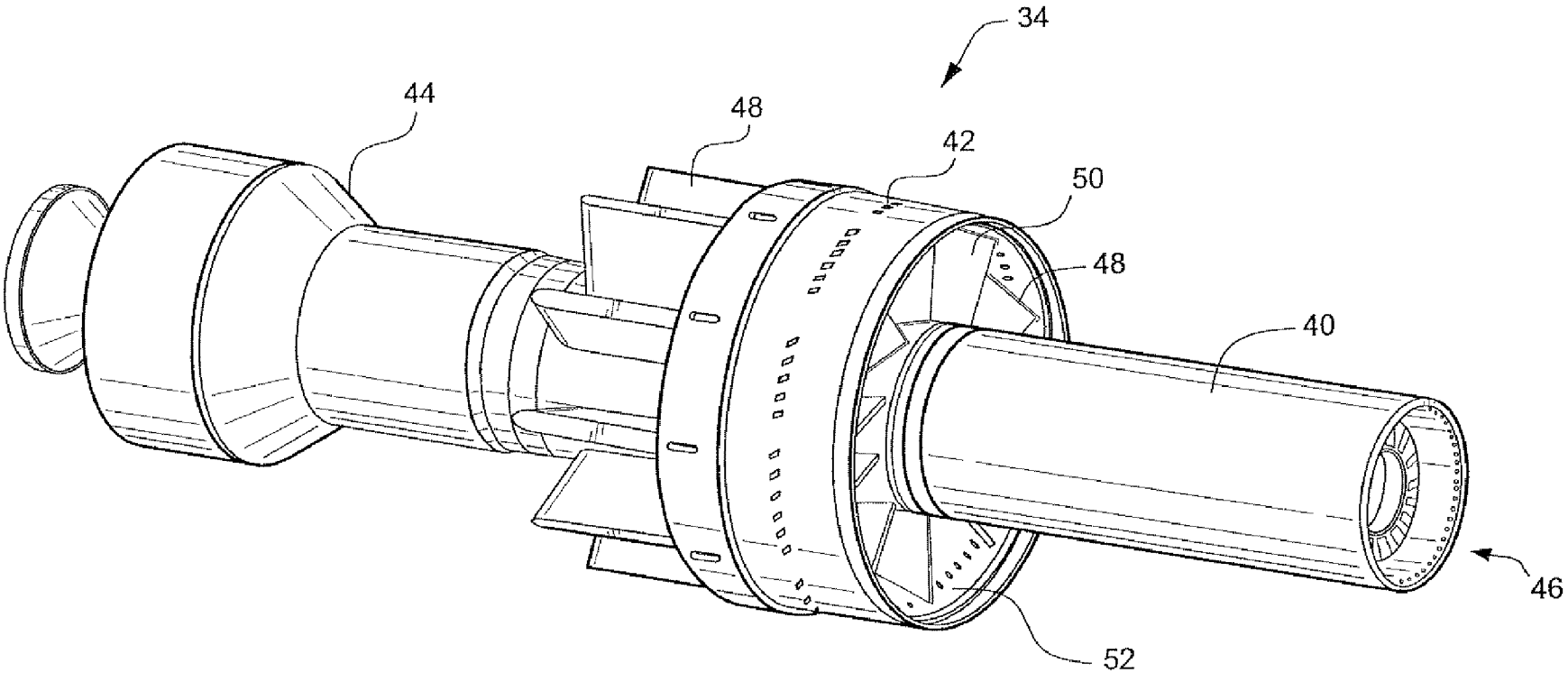
FIG. 2 is a perspective view of a fuel nozzle assembly.

FIG. 2 is a perspective view of a fuel nozzle assembly 34. The nozzle assembly 34 includes a nozzle body 40, a rear collar 42 and a rear section 44 that connects to the end cover assembly of a combustor can. Fuel and air is supplied to the end cover assembly which directs the fuel to the rear section of the fuel nozzle assembly. The rear collar 42 forms an outer ring of an annular air passage 48 that provides premix air to the premix chamber of the combustion can. Within the annular air passage 48 are radial vanes 50 that impart a spiral flow to the premix air flowing through the passage 48. The vanes 50 contain fuel discharge ports 52 (FIG. 4) through which fuel is discharged from the fuel nozzle assembly into the premix chamber, where it mixes with the air flowing in air passage 48. One or more fuel gas passages and fuel discharge ports may be arranged in the vanes 50. The front 46 of the nozzle body includes the forward fuel nozzle ports that deliver fuel directly to the combustion chamber in the combustor can.

Figure 3:
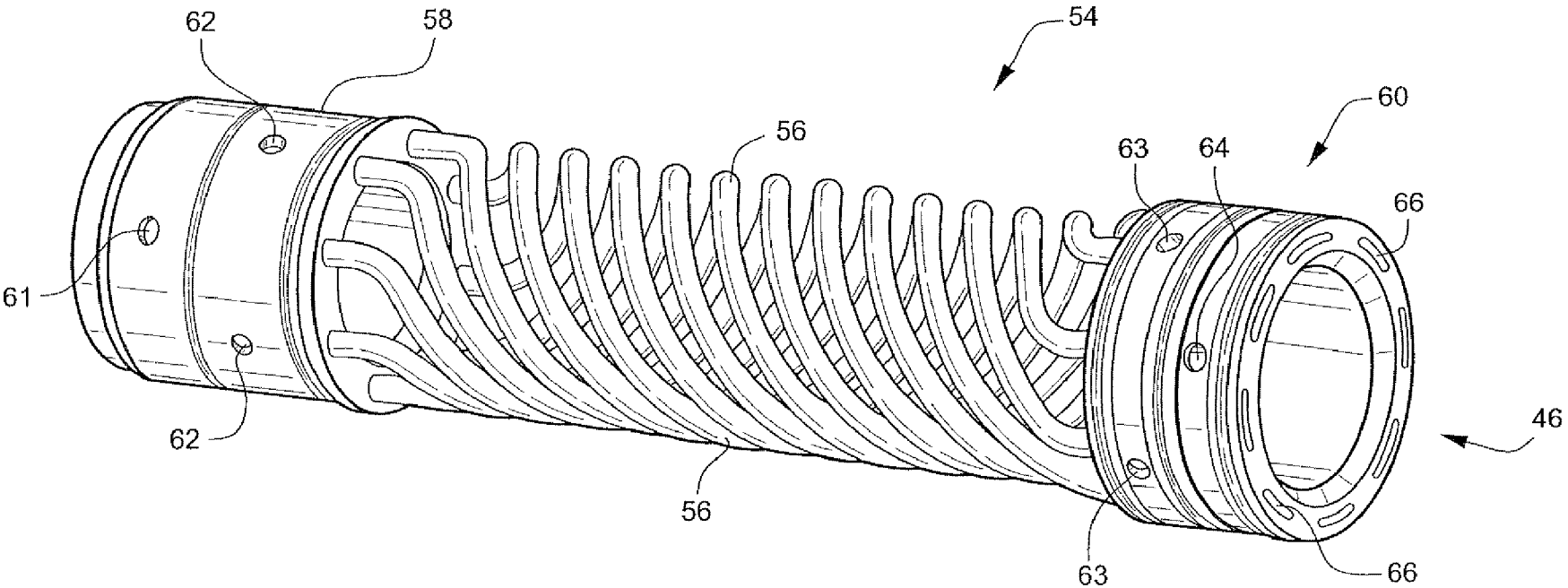
FIG. 3 is a perspective view of a fuse assembly that is incorporated in the fuel nozzle body of the fuel nozzle assembly.

FIG. 3 is a perspective view of a fuse assembly 54 that is incorporated in the fuel nozzle assembly and, specifically, in the collar and nozzle body. The fuse assembly 54 includes a cylindrical array of helical conduits 56 that extend from a cylindrical rear fuse base 58 mounted in the rear collar to a cylindrical front fuse and nozzle base 60 mounted in the front of the nozzle body. The conduits 56 may be brazed to the bases 58, 60. The helical shape of the conduits 56 allows the conduits to expand or contract in an axial direction, such as due to thermal expansion. The rear fuse base 58 includes openings 61, 62 that are aligned with a fuel passage or fuel passages in the collar when the fuse base 58 is inserted in the rear collar. Arranging the openings 61, 62 in two or more rows (as shown in FIG. 3) allows the multiple conduits 56 to receive fuel from multiple premix fuel passages in the collar 42. The openings 61, 62 lead to respective passages in the fuse base 58 and the conduits 56.

Fuel from the fuel passage, that would normally flow to the premix chamber, flows through the rear fuse base 58 and the helical conduits 56 to the nozzle base 60 when the fuse is activated by a flashback event. After the fuse has been activated, the fuel flowing through the helical conduits 56 diverts fuel from the premix chamber(s) to prevent further combustion of fuel in that chamber(s).

Openings 63, 64 on the front fuse and nozzle base 60 allow the fuel from the helical conduits 56 to discharge through the front of the nozzle body and into the combustion chamber. The openings 63, 64 are normally blocked to prevent the flow of fuel through the helical conduits. When the openings 64 are not blocked, the flow of fuel through helical conduits diverts fuel from the premix chamber, so as to quench a flash back or flame holding condition. The front fuse and nozzle base also includes air nozzles 66 for air discharged from the front of the fuel nozzle. The discharged air forms an air curtain around the fuel flowing from the front 46 of the fuel nozzle.

Figure 4:
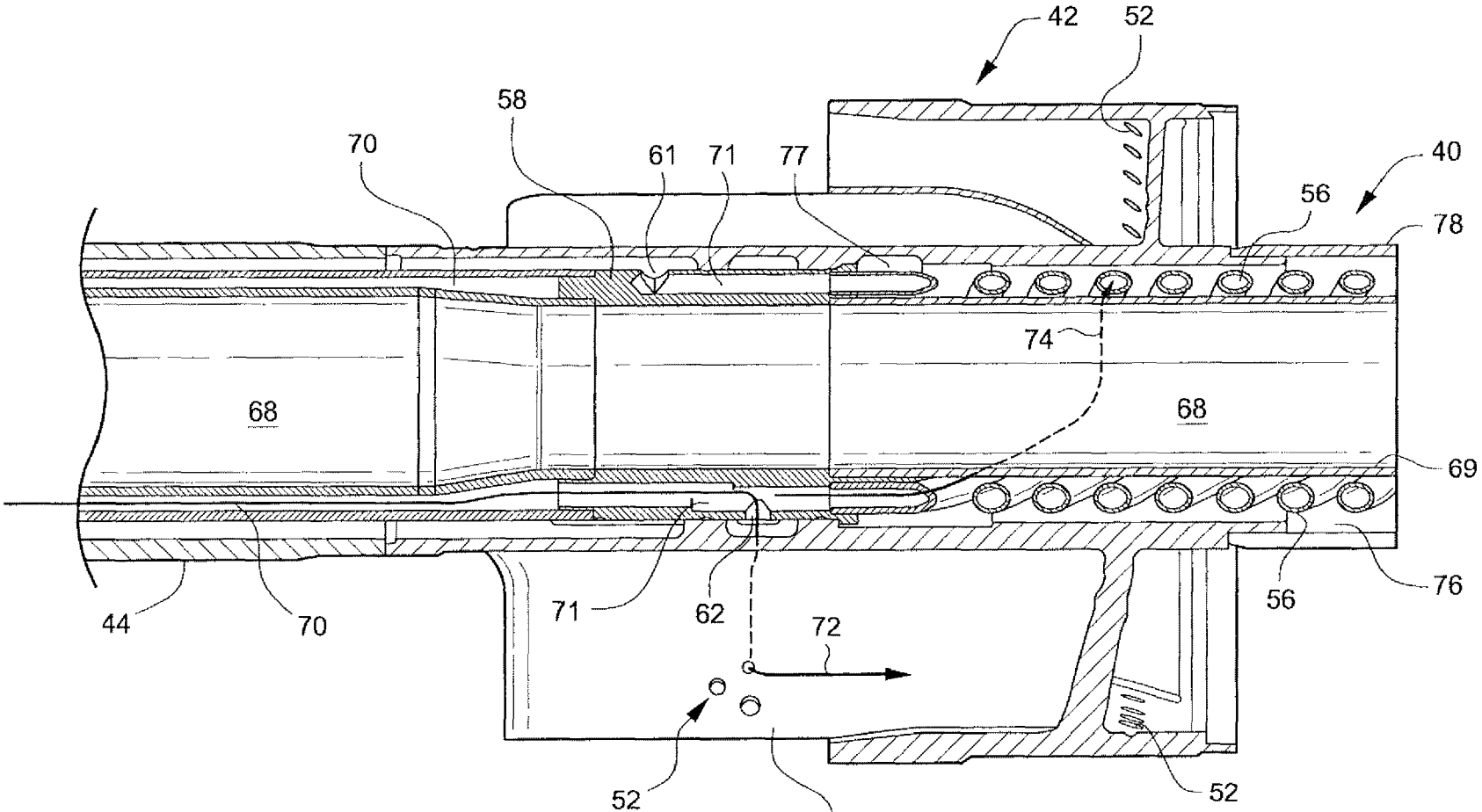
FIG. 4 is a side, cross sectional view of the fuse assembly in the rear collar of the fuel nozzle assembly.

FIG. 4 is a side, cross sectional view of the fuel nozzle assembly and, specifically, the rear collar 42 and rear section 44 of the fuel assembly. The rear fuse base 58 is mounted in the rear collar. A cylindrical gas passage 68 is defined by an inner tubular section 69 aligned with the axis of the fuel nozzle and extending through the rear section 44, the rear collar 42 and the nozzle body 40 of the fuel assembly. An annular gas passage 70 is defined between the inner tube 69 and an outer wall of the passage. Fuel flows through the annular fuel gas passage 70 from the rear section 44 of the fuel assembly to the rear collar 42.

As indicated by flow arrow 72, the fuel gas flows from the gas passage 70, through passages 71 in the rear fuse base 58, the openings 61, 62 that lead to the radial vanes 50 of the rear collar, out the fuel ports 52 in the vanes and into the premix chamber. The gas flows as indicated by arrow 72, unless the fuse has been activated. An single flow arrow 72 is shown to indicate a premix gas path through the rear collar 42 and passages in the vanes 50. However, one or multiple premix gas paths may be in the rear collar and vanes. Each of the premix gas paths may be associated with a different one of the helical conduits 56. Further each of the premix gas paths may be associated with one or more of the helical conduits.

When the fuse is activated, the gas flows from passage 70, through the passages 71 in the rear fuse base 58 and to the helical conduits 56 as indicated by flow arrow 74. The conduits 56 provide a flow path that diverts most of the fuel in passage 70 away from the vanes 50 and the fuel ports 52.

The helical conduits 56 are arranged in an annular air passage 76 between the tube 69 of the gas passage 68 and an outer tubular casing 78 of the nozzle body 40. Air enters through ports 77 in the rear collar 42 and flows into the air passage 76. The air flows through the passage 76, across outer surfaces of the helical conduits 56 and to the front fuse and nozzle base. The size and number of the conduits 56 are such that the air flowing through the passage 76 is sufficient for the curtain of air flow needed at the front of the fuel nozzle. Preferably, the helical conduits occupy less than one half of the volume of the passage 76.

Figure 5:
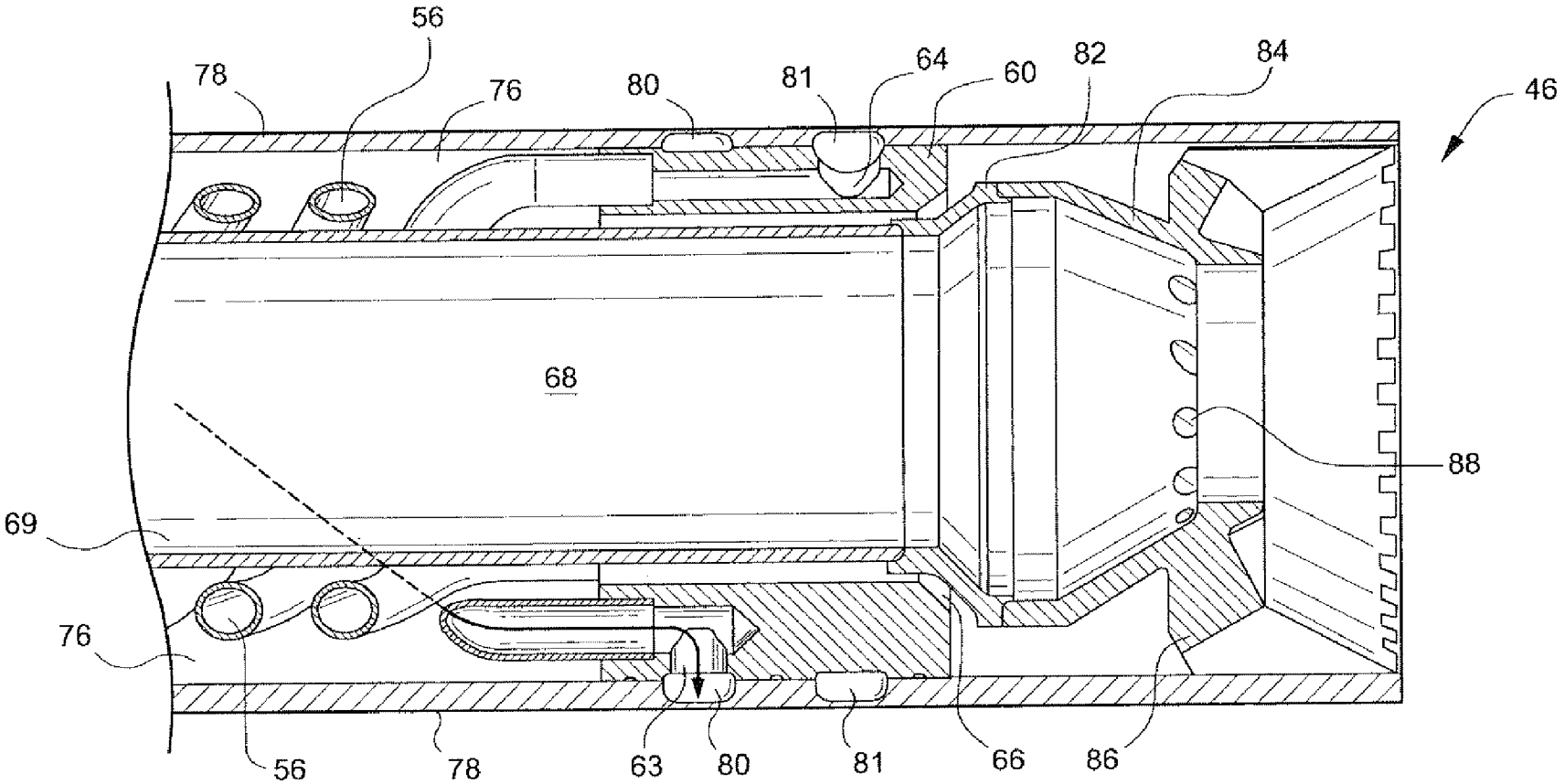
FIG. 5 is a side, cross-sectional view of a front portion of the nozzle body.

FIG. 5 is a side, cross-sectional view of a front portion of the nozzle body 40. The helical conduits 56 are arranged in the annular air passage 76 defined between the inner cylindrical tube 69 of the gas passage 68 and the tubular casing 78 of the nozzle body 40. The helical shape of the conduits 56 allows for axial expansion of the conduits. The front fuse and nozzle base 60 is seated between the wall of the gas passage 68 and the tubular casing 78.

The openings 64 in the front fuse and nozzle base 60 are adjacent a weakened section 80, e.g., a relatively thin annular section, of the casing 78. The weakened sections 80 may be a segmented annular region of the casing 78 that has been machined to remove some of the thickness of the casing wall adjacent the openings 64 of the base 60. The weakened sections 80 are susceptible to burning through in the event of a flashback. Once burned through, the opened weakened sections 80 allow fuel to flow out the openings 64 in the fuse and nozzle base 60 and flow through the helical conduits 56. The flow of fuel through the helical conduits diverts fuel from the premix chamber and starves and quenches any flame occurring in the premix chamber to stop the flash back condition.

The inner cylindrical wall of the gas passage 68 has a front end that fits into a quasi-conical inner sleeve assembly 82 that supports the front nozzle 84. The inner sleeve assembly allows for thermal expansion between the cylindrical wall of the gas passage and the front nozzle. Air from the annular passage 76 flows through the front fuse and nozzle base 60 and through swirl vanes 86 before being discharged around the front of the center fuel discharge nozzle ports 88 for the gas passage 68.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle assembly for a combustor of a gas turbine comprising:

a nozzle body having a front and an inner tube defining a fuel passage extending through the nozzle body, wherein the front is proximate to a combustion section of the combustor;

an outer casing around the inner tube and the outer casing includes a weakened region, wherein an air passage is defined between the outer casing and the inner tube;

an expandable fuel conduit arranged in the air passage and radially outward of the inner tube, an expandable fuel conduit having an outlet which is both proximate to the front of the nozzle body and adjacent the weakened region, wherein fuel flows through an expandable fuel conduit only after a flashback condition occurs in the combustor and opens the weakened region, and a premix fuel passage and port discharging fuel to a premix section of the combustor, wherein an expandable fuel conduit has an inlet open to the premix fuel passage and the port is radially outward of the outer casing.

2. The fuel nozzle assembly as in claim 1 wherein an expandable fuel conduit expands along a length of the air passage.

3. The fuel nozzle assembly as in claim 1 wherein an expandable fuel conduit has a helical shape.

4. The fuel nozzle assembly as in claim 1 wherein the expandable conduit is a plurality of expandable conduits and the premix fuel passage is a plurality of passages, and a first of the expandable conduits has an inlet open to a first of the premix fuel passages and a second of the expandable conduits has an inlet open to a second of the premix fuel passages.

5. The fuel nozzle assembly as in claim 1 wherein an expandable fuel conduit occupies less than one half of a volume of the air passage.

6. The fuel nozzle assembly as in claim 1 wherein the outer casing has a weakened region adjacent an outlet of a cylindrical body including the outlet of an expandable fuel conduit, wherein the flashback condition burns through the weakened region.

7. A fuel nozzle assembly for a combustor of a gas turbine comprising:

a nozzle body having a front and an inner tube defining a fuel passage extending through the nozzle body;

an outer tube around the inner tube and defining an air passage between the outer tube and the inner tube;

a weakened region of the outer tube which burns through in event of a flashback thereby causing premix fuel to flow through the burned weakened region of the outer tube;

an expandable conduit arranged in the air passage and radially outward of the inner tube, and the expandable conduit having an outlet adjacent the weakened region, wherein fuel flows through the expandable conduit when the weakened region of the outer tube burns through and the fuel flows from the conduit, through the weakened region and towards the front of the nozzle body, and a collar attached to the nozzle body, the collar including a premix fuel passage, wherein the expandable conduit has an inlet open to the premix fuel passage and the premix fuel passage extends to a port which discharges the fuel wherein the port is radially outward of the outer tube.

8. The fuel nozzle assembly as in claim 7 wherein the expandable conduit has a helical shape.

9. The fuel nozzle assembly as in claim 7 wherein the expandable conduit is a plurality of expandable conduits and the premix fuel passage is a plurality of passages, and a first of the expandable conduits has an inlet open to a first of the premix fuel passages and a second of the expandable conduits has an inlet open to a second of the premix fuel passages.

10. The fuel nozzle assembly as in claim 7 wherein the expandable conduit occupy less than one half of a volume of the air passage.

11. The fuel nozzle assembly as in claim 7 wherein air from the air passage discharges through nozzles in the front of the nozzle body.

12. The fuel nozzle assembly as in claim 7 wherein the collar is adapted to be aligned with a premix chamber of a combustion can.

13. The fuel nozzle assembly as in claim 7 wherein the combustor includes a combustion can and the fuel nozzle assembly is at least one fuel nozzle assembly arranged in the combustion can.

14. The fuel nozzle assembly as in claim 7 further comprising a fuse and nozzle cylindrical body having an outer surface adjacent an inner surface of the outer tube and an inner end coupled to the expandable conduit.

15. A method for quenching a flashback condition in a combustor of a gas turbine, the method comprising:

injecting fuel and compressed air from a fuel injector assembly to a premix chamber of the combustor, wherein the injected fuel and compressor air does not normally combust in the premix chamber;

combusting the fuel and compressed in a combustion chamber downstream of the premix chamber in the combustor;

providing air to the combustion chamber from a front of the injector assembly through an air passage extending through a nozzle body of the fuel injector;

injecting fuel to the combustion chamber from a fuel passage having an outlet at the front of the injector assembly;

in response to a flashback condition, opening an outlet of a conduit adjacent the fuel injector assembly and radially inward of the premix chamber, wherein the outlet is proximate the front of the injector assembly, wherein the conduit extends through and is inside of the air passage;

diverting fuel from the premix chamber to the conduit by the opening of the outlet, and quenching flames of the flashback condition by the diversion of fuel.

16. The method of claim 15 further comprising expanding an axial length of the conduit in response to thermal conditions.

17. The method of claim 15 wherein the conduit has a helical shape and wraps around the fuel passage.

18. The method as in claim 15 wherein air from the air passage discharges through nozzles in the front of the fuel nozzle assembly and forms an air curtain.

19. The method as in claim 15 wherein the outlet is opened by burning through a weakened portion of the nozzle body.

20. The method as in claim 15 wherein the conduit is a plurality of helical conduits extending through the air passage and the premix chamber receives fuel from a plurality of premix fuel passages, and a first of the expandable conduits has an inlet open to a first of the premix fuel passages and a second of the expandable conduits has an inlet open to a second of the premix fuel passages.

* * * * *

UNITED STATES PATENT AND TRADEMARK OFFICE

CERTIFICATE OF CORRECTION

PATENT NO. : 8,281,595 B2
APPLICATION NO. : 12/128231
DATED : October 9, 2012
INVENTOR(S) : Lewis Davis et al.

It is certified that error appears in the above-identified patent and that said Letters Patent is hereby corrected as shown below:

In Claim 1 at column 5, lines 31-32, replace “an expandable fuel conduit” with --the expandable fuel conduit--

In Claim 1 at column 5, lines 34-35, replace “an expandable fuel conduit” with --the expandable fuel conduit--

In Claim 1 at column 5, lines 38-39, replace “an expandable fuel conduit” with --the expandable fuel conduit--

In Claim 2 at column 5, lines 42-43, replace “an expandable fuel conduit” with --the expandable fuel conduit--

In Claim 3 at column 5, lines 45-46, replace “an expandable fuel conduit” with --the expandable fuel conduit--

In Claim 5 at column 5, lines 53-54, replace “an expandable fuel conduit” with --the expandable fuel conduit--

In Claim 6 at column 5, lines 58-59, replace “an expandable fuel conduit” with --the expandable fuel conduit--

Signed and Sealed this
Twelfth Day of February, 2013

Teresa Stanek Rea
*Acting Director of the United States Patent and Trademark Office*